US005758244A

United States Patent [19]

Iwakura

[11] Patent Number: 5,758,244

[45] Date of Patent: May 26, 1998

[54] TRANSFER DEVICE FOR AN IMAGE FORMING APPARATUS

[75] Inventor: Yoshie Iwakura, Nara, Japan

[73] Assignee: Sharp Kabushiki Kaisha, Osaka, Japan

[21] Appl. No.: 861,733

[22] Filed: May 22, 1997

[30] Foreign Application Priority Data

May 29, 1996 [JP] Japan ..... 8-134849

[51] Int. Cl.[6] ..... G03G 15/16

[52] U.S. Cl. ..... 399/313; 399/297; 399/314

[58] Field of Search ..... 399/45, 66, 297, 399/298, 303, 310, 313, 314, 318

[56] References Cited

U.S. PATENT DOCUMENTS

| | | | |
|---|---|---|---|
| 4,407,580 | 10/1983 | Hashimoto et al. | 399/313 |
| 4,739,361 | 4/1988 | Roy et al. | 399/313 |
| 5,250,994 | 10/1993 | Ito et al. | 399/303 X |
| 5,390,012 | 2/1995 | Miyashiro et al. | 355/273 |
| 5,517,290 | 5/1996 | Marumoto et al. | 399/313 |
| 5,623,329 | 4/1997 | Yamauchi et al. | 399/314 |
| 5,689,758 | 11/1997 | Wataki et al. | 399/45 |
| 5,697,034 | 12/1997 | Iwakura et al. | 399/313 |

FOREIGN PATENT DOCUMENTS 6-167892 6/1994 Japan .

*Primary Examiner*—Sandra L. Brase

[57] ABSTRACT

An image forming apparatus includes a photoconductor drum on whose surface a toner image is formed, a transfer drum, including a dielectric layer, a pressure conductive layer whose volume resistivity falls by the application of pressure, and a conductive layer stacked in this order from a surface of the transfer drum, for transferring the toner image formed on the photoconductor drum onto a transfer sheet by electrically attracting and holding the transfer sheet onto a surface of the dielectric layer and by bringing the transfer sheet into contact with the photoconductor drum, power source section for applying a voltage to the conductive layer, and a grounded ground roller for coming into contact with the surface of the dielectric layer via the transfer sheet. This makes it possible to always maintain the amount of electric charge injected to the transfer material at an optimum value by adjusting a contact pressure between the transfer section and the contact and charge member. As a result, it is possible to electrostatically attract the transfer material onto the transfer section stably, regardless of a kind of the transfer material.

25 Claims, 12 Drawing Sheets

TRANSFER DEVICE FOR AN IMAGE FORMING APPARATUS

TRANSFER DEVICE FOR AN IMAGE FORMING APPARATUS

1. Field of the Invention

The present invention relates to image forming apparatuses used for, for example, laser printers and laser facsimiles, and more particularly relates to configurations of transfer means such as a transfer drum for producing a color image by performing a toner transfer more than once while holding a transfer material thereon.

2. Background of The Invention

A conventionally known image forming apparatus lets toner adhere to an electrostatic latent image formed on a photoconductor drum, develops the electrostatic latent image and transfers the toner image onto a transfer sheet that is a transfer material wound around a transfer drum.

Such an image forming apparatus includes a cylinder 101 with a dielectric layer 101*a*, in which, for example, a corona charger 102 for attracting a transfer sheet P onto the cylinder 101 and a corona charger 104 for transferring a toner image formed on the surface of a photoconductor drum 103 onto the transfer sheet P are separately disposed as shown in FIG. 21. The corona chargers 102 and 104 respectively attracts the transfer sheet P onto the cylinder 101 and transfers a toner image onto the transfer sheet P.

FIG. 22 shows an image forming apparatus of another type that includes a cylinder 201 and a grip mechanism 202. The cylinder 201 has a double layer structure composed of a semiconductor layer (outer layer) 201*a* and a base (inner layer) 201*b*. The grip mechanism 202 holds onto the cylinder 201 a transfer sheet P that has been transported. The image forming apparatus holds the transported transfer sheet P at its edge with the grip mechanism 202 to stick it to the surface of the cylinder 201, charges the surface of the cylinder 201 by applying a voltage to the semiconductor layer 201*a* that is the outer layer of the cylinder 201 or by discharging toward the cylinder 201 a charger disposed inside the cylinder 201, and then transfers the toner image on the photoconductor drum 103 onto the transfer sheet P.

The image forming apparatus shown in FIG. 21 has a restriction on the size of the cylinder 101 and has a problem in reducing its size, since the cylinder 101 that is a transfer roller has a single layer structure composed only of the dielectric layer 101*a*, and the corona chargers 102 and 104 needs to be disposed inside the cylinder 101.

By contrast, the image forming apparatus shown in FIG. 22 needs less chargers, since the cylinder 201 that is a transfer roller for transferring the toner image onto the transfer sheet P is charged with the double layer structure thereof. Nevertheless, the image forming apparatus, including the grip mechanism 202, has a complex overall structure that includes a large number of components, increasing the manufacturing cost of the apparatus.

In view of these problems, Japanese Laid-Open Patent Application No. 5-173435/1993 (Tokukaihei 5-173435) discloses a transfer device for forming a color image on a transfer material by transferring toner images of different colors, sequentially one over the other, formed on an image carrier onto the transfer material carried on a transfer material carrier composed of a drum, an elastic layer wound around the drum and a dielectric layer covering the elastic layer.

The transfer device uses an attracting roller for attracting the transfer material onto the transfer material carrier, and is provided with a hollow layer of more than 10 μm between the dielectric layer and the elastic layer by forming the elastic layer with foamed urethane rubber, so as to improve the attracting capability of the transfer material carrier.

Nonetheless, generally, as the hollow layer between the dielectric layer and the elastic layer becomes thicker, the applied voltage required to electrostatically attract the transfer material onto the dielectric layer becomes higher. So the transfer device has a security problem and a disadvantage in terms of cost.

In addition, since the electrostatic attracting force of a transfer material varies depending upon the kind of the transfer material, it is necessary to change the charging amount of the transfer material to stably perform electrostatic attraction regardless of the kind of the transfer material. However, the above Application does not disclose how the charging amount is changed.

A change in the environments possibly causes dew in the hollow space and/or changes the thickness of the hollow space. So the configuration of the transfer device is not stable.

The elastic layer of the transfer device is made of foamed urethane rubber. Therefore, the hollow space that grows between the dielectric layer and the elastic layer is likely to be unstable due to a change in the environments. Besides, with the transfer device, the charging amount cannot be changed corresponding to the kind of the transfer material (e.g., paper or a sheet made of synthetic resin for use with an overhead projector (OHP)), a change in the environments (e.g., humidity), etc. As a result, the transfer device has a problem of being incapable of electrostatically attracting a transfer material nor transferring toner in a stable manner.

SUMMARY OF THE INVENTION

An object of the present invention is to offer an image forming apparatus capable of electrostatically attracting a transfer material in a stable manner regardless of the kind of the transfer material.

In order to accomplish the above object, an image forming apparatus in accordance with the present invention is characterized in that it includes:

- an image carrier (e.g., a photoconductor drum) on whose surface a toner image is formed,
- a transfer section (e.g., a transfer drum), including a dielectric layer, a pressure conductive layer whose volume resistivity falls by the application of pressure, and a conductive layer stacked in this order from a surface of the transfer section, for transferring the toner image formed on the image carrier onto a transfer material by electrically attracting and holding the transfer material onto a surface of the dielectric layer and by bringing the transfer material into contact with the image carrier,
- a power source for applying a voltage (a first voltage) to the conductive layer, and
- a contact and charge member for coming into contact with the surface of the dielectric layer via the transfer material and for charging the transfer material.

According to the configuration, a pressure conductive layer whose volume resistivity falls by the application of pressure is provided between the dielectric layer and the conductive layer. This makes it possible to adjust the volume resistivity of the pressure conductive layer by adjusting a contact pressure between the contact and charge member and the transfer section, and as a result, makes it possible to adjust the amount of electric charge injected to the transfer material. Accordingly, even if a transfer material of a different kind is used, it is possible to always maintain the amount of electric charge injected to the transfer material at an optimum value by adjusting the contact pressure between the transfer section and the contact and charge member. As a result, it is possible to electrostatically attract the transfer material onto the transfer section stably, regardless of the kind of the transfer material.

The image forming apparatus in accordance with the present invention preferably further includes a transfer material sensing section for sensing the kind of the transfer material, wherein the contact pressure adjusting section is configured to adjust the contact pressure between the contact and charge member and the transfer section according to the kind of the transfer material sensed by the transfer material sensing section. This makes it possible to provide an optimum charged potential to the transfer material regardless of the kind of the transfer material, and therefore enables the transfer material to be surely electrostatically attracted. Consequently, the image forming is stably performed.

The contact and charge member needs to be in contact with the surface of the dielectric layer via the transfer material. However, the transfer material is preferably pressed against the dielectric layer so as to pressurize the pressure conductive layer.

The contact and charge member may be an electrode member (a first electrode member) such as a grounded roller. However, the contact and charge member is preferably an electrode member (a second electrode member) such as a roller connected to a power source supplying a voltage (a second voltage) having a polarity opposite to that of the applied voltage to the conductive layer (the first voltage). This makes it possible to raise the charged potential while maintaining the transfer voltage of the toner. As a result, the charged potential of the transfer material that tends to be insufficient when the transfer voltage of the toner is set to an optimum value can be raised to an optimum value, thereby more surely performing the electrostatic attraction of the transfer material while properly performing the toner transfer.

If there are provided a plurality of contact and charge members, it is possible to provide a predetermined charged potential to the transfer material with a lower contact pressure between the contact and charge member and the transfer section. Consequently, it is possible to more surely prevent too strong a contact pressure from causing the transfer material to curl not in accordance with the surface of the transfer section (curl in the opposite direction).

For a fuller understanding of the nature and advantages of the invention, reference should be made to the ensuing detailed description taken in conjunction with the accompanying drawings.

DESCRIPTION OF THE EMBODIMENTS

[First Embodiment]

Referring to FIGS. 1 through 13, the following description will discuss an embodiment in accordance with the present invention.

First, the basic structure of the image forming apparatus of the present embodiment will be explained with reference to FIG. 1.

Figure 1:
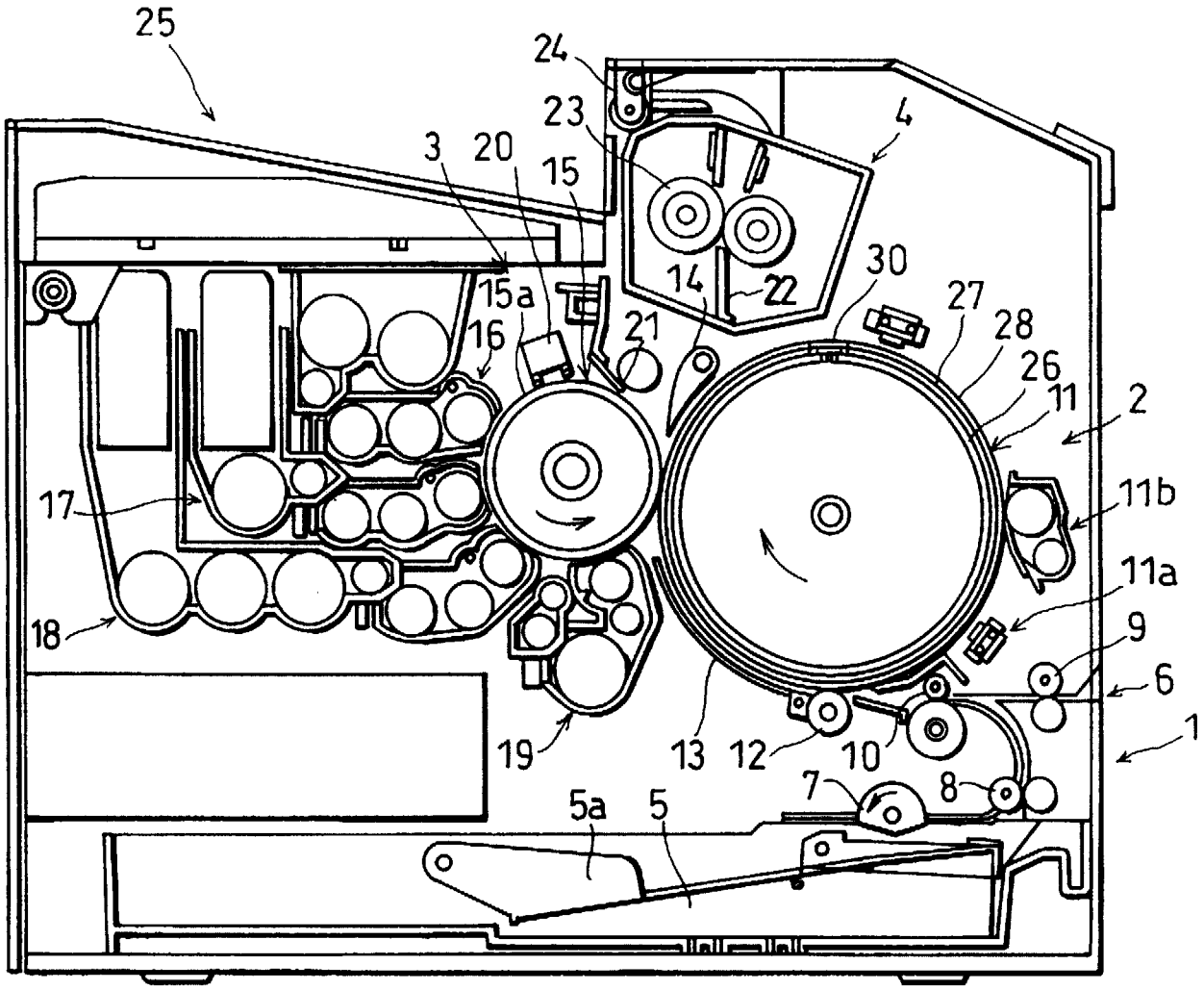
FIG. 1 is a schematic cross-sectional view showing an image forming apparatus of an embodiment in accordance with the present invention.

The image forming apparatus of the present embodiment, as shown in FIG. 1, is composed of a paper feed section 1 for storing and feeding transfer sheets P (see FIG. 2) as transfer materials on which images are formed with toner, a transfer section 2 for transferring a toner image onto the transfer sheet P, a developing section 3 for forming the toner image, and a fixing section 4 for fixing the toner image transferred onto the transfer sheet P by melting the toner. In the present embodiment, a sheet of recording paper and a sheet made of synthetic resin for use with an OHP (hereinafter, will be referred to as an OHP sheet) are used as the transfer sheet P.

The paper feed section 1 includes a paper feed cassette 5, disposed at the lowest portion of the main body so as to be freely installed and removed, for storing and feeding the transfer sheets P to the transfer section 2, and a manual paper feed section 6, disposed on the front side of the main body, for manually feeding the transfer sheets P sheet by sheet from the front side. The paper feed section 1 includes a pickup roller 7 for sending out the transfer sheets P sheet by sheet from the top portion of the paper feed cassette 5, a pre-feed roller (PF roller) 8 for transporting the transfer sheet P sent out by the pickup roller 7, a manual feed roller 9 for transporting the transfer sheet P fed from the manual paper feed section 6, and a pre-curl roller (PS roller) 10 for curling the transfer sheet P transported by the pre-feed roller 8 and the manual feed roller 9 before reaching the transfer section 2.

The paper feed cassette 5 has a sending-out member 5*a* pushed upward by, for example, a spring. The transfer sheets P are piled on the sending-out member 5*a*. The pile of the transfer sheets P in the paper feed cassette 5 is pressed at their top against the pickup roller 7. The transfer sheets P on top of the pile are thus sent out sheet by sheet to the PF roller 8 by the rotation of the pickup roller 7 in the direction denoted by the arrow, and are transported to the pre-curl roller 10.

Meanwhile, the transfer sheet P fed from the manual paper feed section 6 is transported to the pre-curl roller 10 by the manual feed roller 9.

The pre-curl roller 10 curls the transfer sheet P transported in the above manner according to the surface of a cylindrical transfer drum 11 so that the transfer sheet P is easily attracted onto the surface of the cylindrical transfer drum 11 provided to the transfer section 2.

The transfer section 2 includes the transfer drum 11 as transfer means. Around the transfer drum 11 are provided a ground roller 12 as a grounded first electrode member (contact and charge member), a guide member 13 for guiding the transfer sheet P so that the transfer sheet P does not fall off from the transfer drum 11, a peel-off claw 14 for forcefully peeling the transfer sheet P attracted onto the transfer drum 11 off the transfer drum 11, etc.

Figure 8:
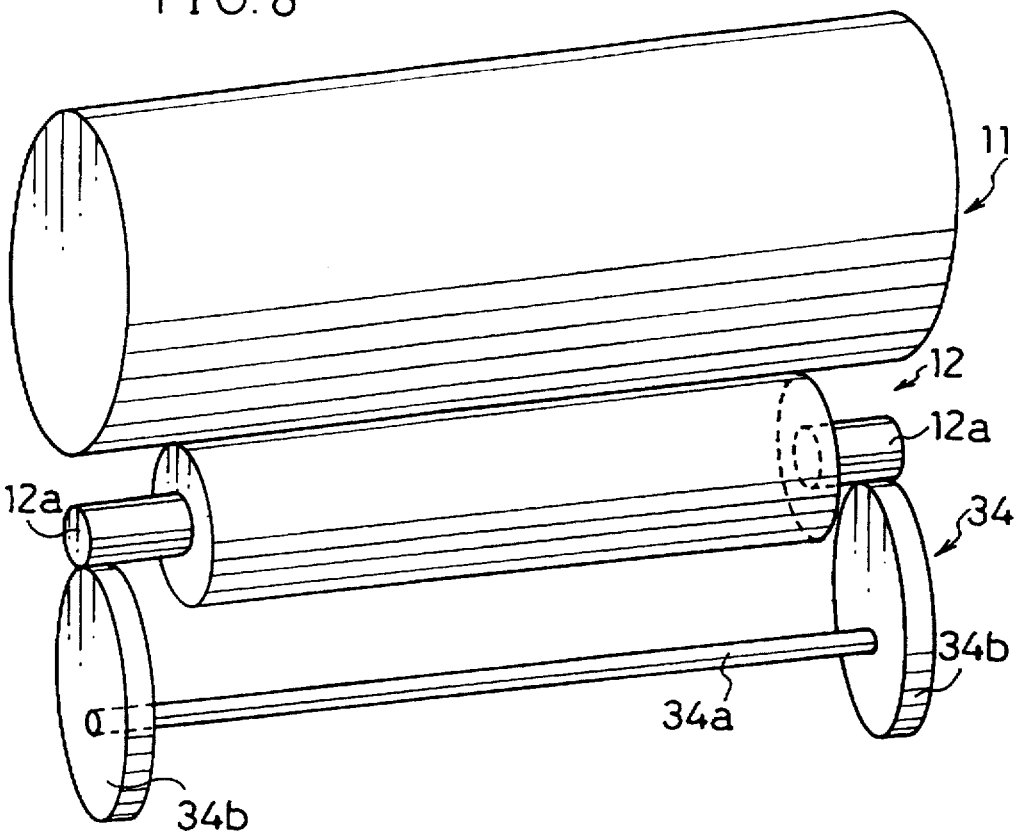
FIG. 8 is a schematic perspective view showing a contact pressure adjusting section for adjusting the contract pressure of the transfer drum and the ground roller of the image forming apparatus shown in FIG. 2.

The ground roller 12 is an electrode member made of a conductive material, and is pressed against the surface of the transfer drum 11 via the transfer sheet P by an eccentric cum 34 (will be described later in detail; see FIGS. 8 and 9). The ground roller 12 is disposed on the upstream side of the transfer position of a toner image onto the transfer sheet P with respect to the direction along which the transfer sheet P is transported.

The transfer drum 11 electrostatically attracts the transfer sheet P onto the surface thereof. A discharger 11*a* is disposed on the upstream side of the ground roller 12 near the transfer drum 11 as discharging means for removing the electric charge remaining on the surface of the transfer drum 11 after the transfer sheet P is peeled off.

A cleaner 11*b* is disposed on the upstream side of the discharger 11*a* near the transfer drum 11 as cleaning means for removing toner and the like adhering to the surface of the transfer drum 11. The peel-off claw 14 is disposed on the surface of the transfer drum 11 in a detachable manner. The transfer drum 11 will be later explained in detail in terms of its structure.

The developing section 3 is provided with a photoconductor drum 15 as an image carrier pressed against the transfer drum 11. The photoconductor drum 15 is composed of a conductive and grounded aluminum plain cylinder 15*a*. An organic photoconductor (OPC) film is formed on the surface of the photoconductor drum 15.

Developers 16, 17, 18 and 19 for storing toner of yellow, magenta, cyan and black colors respectively are disposed around the photoconductor drum 15 in radial directions. Also disposed around the photoconductor drum 15 are a charger 20 for charging the surface of the photoconductor drum 15, an image spacing eraser (not shown) and a cleaning blade 21 as toner removing means for sweeping and removing residual toner on the surface of the photoconductor drum 15. A toner image is formed on the photoconductor drum 15 for toner of each color.

More specifically, charging, exposure, development and transfer are performed on the photoconductor drum 15 for each color. Therefore, as to a color transfer, a toner image of one of the four colors is transferred for every rotation of the transfer drum 11 onto the transfer sheet P attracted onto the transfer drum 11, and it takes four rotations at most to obtain a color image.

The surface of the photoconductor drum 15 is exposed to light by directing light radiating from an optical system (not shown) between the charger 20 and the cleaning blade 21. Besides, in the present embodiment, taking the transfer efficiency and image quality into consideration, the photoconductor drum 15 and the transfer drum 11 are pressed against each other with a pressure of 2 kg, measured at the transfer portion.

The fixing section 4 includes a fixing roller 23 for fixing a toner image onto the transfer sheet P by melting the toner image at a predetermined temperature with a predetermined pressure, and a guide 22 for guiding to the fixing roller 23 the transfer sheet P that has been peeled off the transfer drum 11 by the peel-off claw 14 after transferring the toner image.

An ejection roller 24 is disposed on the downstream side of the fixing section 4 with respect to the direction along which the transfer sheet P is transported, to eject the transfer sheet P to an ejection tray 25 out of the main body of the apparatus after fixing.

Now the structure of the transfer drum 11 will be explained in detail with reference to FIG. 2.

Figure 2:
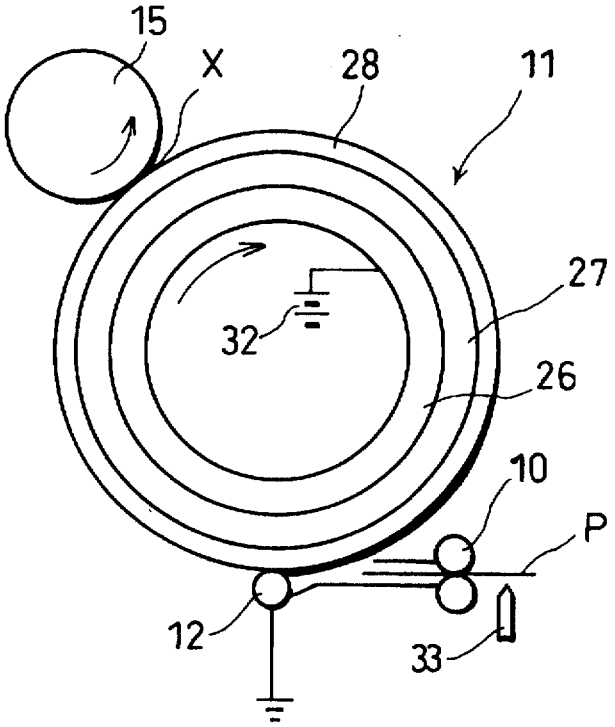
FIG. 2 is a cross-sectional view showing a main part of the image forming apparatus of the embodiment in accordance with the present invention.
Figure 3:
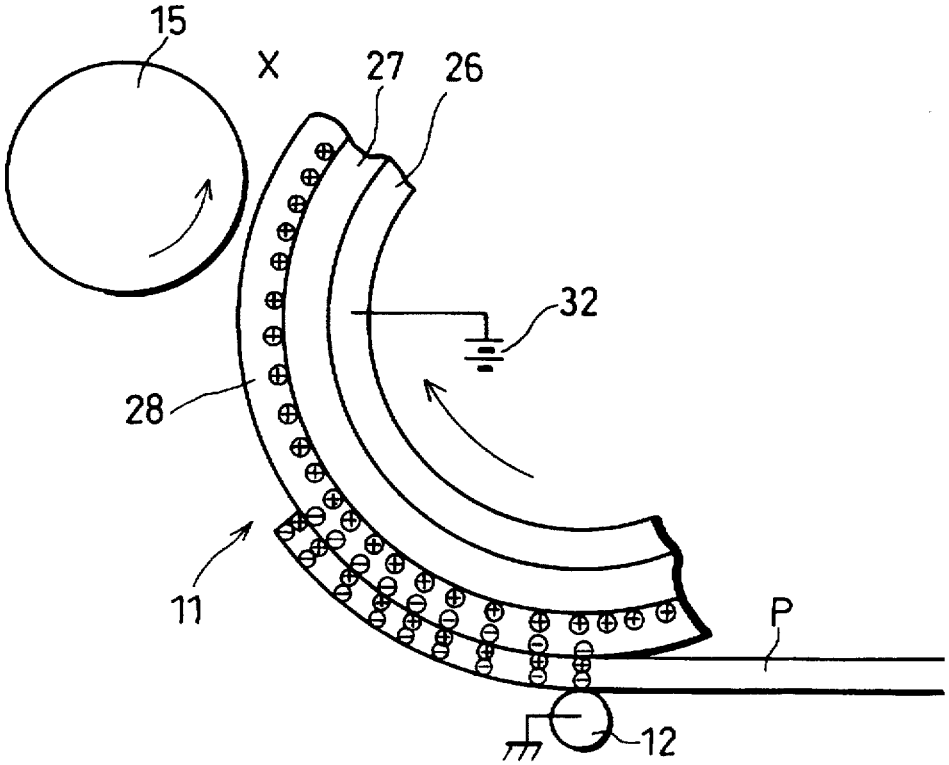
FIG. 3 is an explanatory view showing a charged state of the transfer drum shown in FIG. 2, and is an explanatory view showing an initial state in which a transfer sheet is transported to the transfer drum.

The transfer drum 11 includes a conductive layer 26 which is a cylinder made of aluminum as a base as shown in FIG. 2. On the conductive layer 26 is provided a pressure conductive layer 27 whose resistance varies depending upon a pressure applied thereto. On the pressure conductive layer 27 is provided a dielectric layer 28 made of polyvinylidene fluoride (PVDF). The dielectric layer 28 produces an appropriate attracting force and transfer efficiency with the transfer sheet P when its dielectric constant is in a range of 8 to 12 and its layer thickness is in a range of 100 μm to 300 μm.

The conductive layer 26 may be made of a different conductive substance from aluminum. The dielectric layer 28 may be made of a different dielectric substance from polyvinylidene fluoride such as polyethyleneterephthalate.

The conductive layer 26 is connected to a power source supplying section 32 as voltage applying means, and maintains a stable voltage all around the conductive layer 26. A transfer sheet sensor (transfer material sensing means) 33 for sensing the kind of the transfer sheet P is disposed on the upstream side of the pre-curl roller 10 with respect to the direction along which the transfer sheet P is transported.

The transfer drum 11 and the photoconductor drum 15 are pressed against each other to have a predetermined nip width at the transfer point X.

Now, the attraction of the transfer sheet P by the transfer drum 11 will be explained in detail with reference to FIGS. 3 through 6. It is supposed that the power source supplying section 32 applies a positive voltage to the conductive layer 26 of the transfer drum 11.

The electric charge generating mechanism for electrostatically attracting the transfer sheet P with the ground roller 12 is primarily constituted of Paschen's discharge and electric charge injection.

Figure 5:
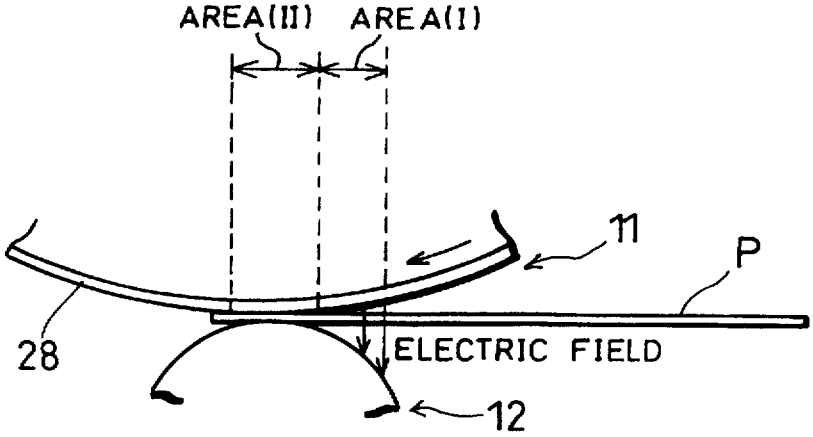
FIG. 5 is an explanatory view showing Paschen's discharge at a firm contact portion between the transfer drum and a ground roller of the image forming apparatus shown in FIG. 2.

Paschen's discharge is an electric discharge from the transfer drum 11 to the ground roller 12 that occurs in Area (I) in FIG. 5 when air insulation breaks down as the strength of the electric field increases where the dielectric layer 28 of the transfer drum 11 contacts the ground roller 12 as a result of a decreasing distance between the dielectric layer 28 and the ground roller 12. As Paschen's discharge occurs, negative electric charge is stored on the surface of the dielectric layer 28 of the transfer drum 11 and positive electric charge is stored on a side of the transfer sheet P facing the transfer drum 11.

Meanwhile, the electric charge injection occurs in a nip between the transfer drum 11 and the ground roller 12, i.e., in the Area (II) in FIG. 5, after Paschen's discharge is completed. As a result, negative electric charge is further stored on the transfer drum 11 from the ground roller 12.

Figure 4:
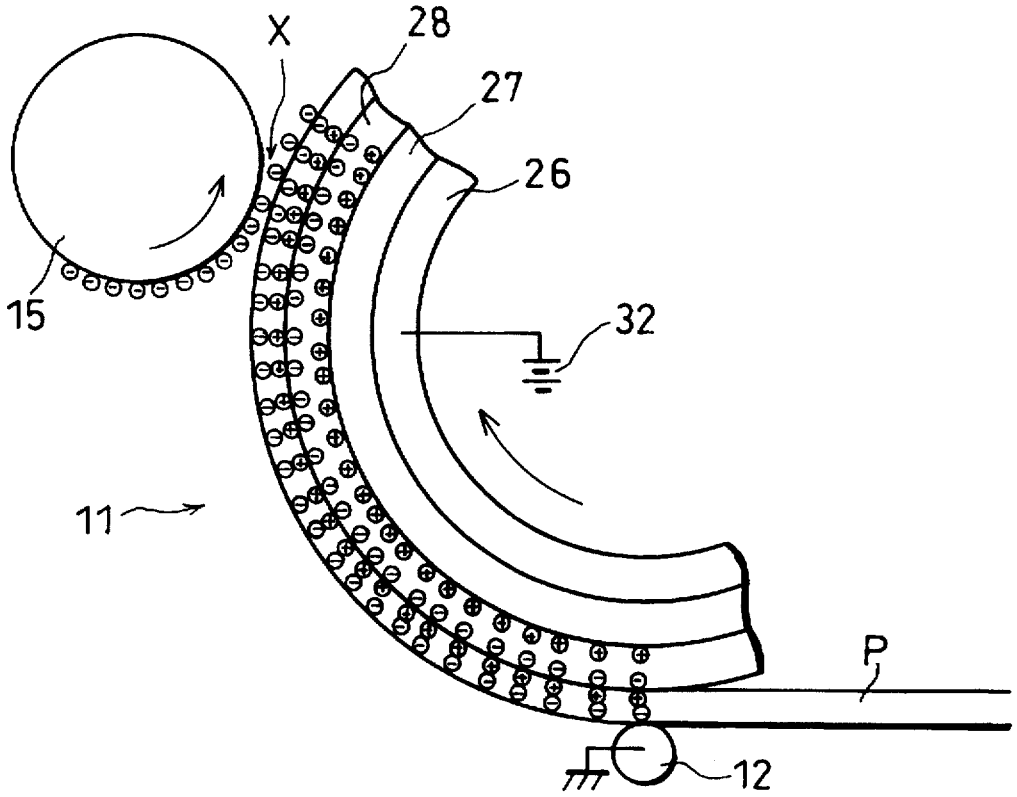
FIG. 4 is an explanatory view showing a charged state of the transfer drum showing in FIG. 2, and is an explanatory view showing a state in which the transfer sheet has been transported to a transfer position of the transfer drum.

In this manner, positive electric charge is stored on the inner side of the transfer sheet P, i.e., on the side of the transfer sheet P which contacts the dielectric layer 28, by Paschen's discharge and the electric charge injection which follows Paschen's discharge as shown in FIG. 4. As a result, the transfer sheet P is electrostatically attracted onto the transfer drum 11.

The electrostatic attracting force of the transfer drum 11 to the transfer sheet P does not vary, as long as the same kind of transfer sheets P are used and the applied voltage to the conductive layer 26 is stable. Accordingly, the transfer sheet P can be stably attracted onto the transfer drum 11.

Figure 6:
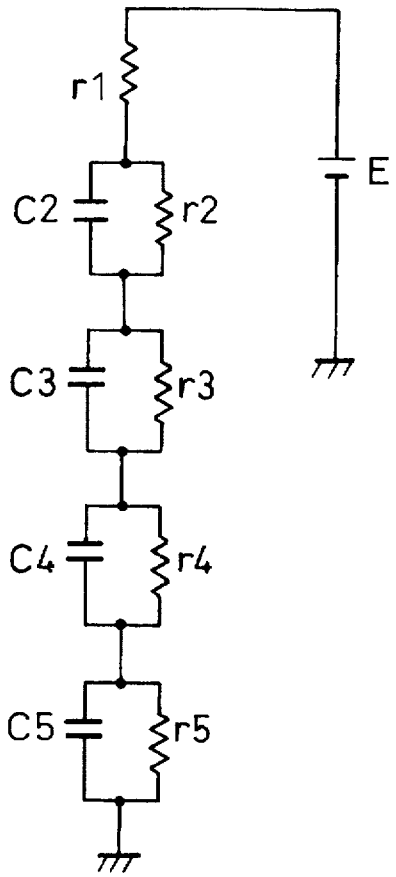
FIG. 6 is circuit diagram showing an equivalent circuit of an electric charge injecting mechanism between the transfer drum and the ground roller of the image forming apparatus shown in FIG. 2.

FIG. 6 shows an equivalent circuit of the electric charge injecting mechanism. The electric charge injection is equivalent to storing electric charge in a capacitor with an electric current flowing within the circuit. In FIG. 6, E represents an applied voltage applied by the power source supplying section 32 (shown in FIGS. 3 and 4) to the conductive layer 26, r1 represents the resistance of the pressure conductive layer 27, r2 represents the contact resistance between the pressure conductive layer 27 and the dielectric layer 28, r3 represents the resistance of the dielectric layer 28, r4 represents the resistance of the transfer sheet P, r5 represents the contact resistance between the transfer sheet P and the ground roller 12, C2 represents the capacitance of the hollow space between the pressure conductive layer 27 and the dielectric layer 28, C3 represents the capacitance of the dielectric layer 28, C4 represents the capacitance of the transfer sheet P, C5 represents the capacitance of the hollow space between the transfer sheet P and the ground roller 12.

To determine the value of the electric charge (potential) stored in C4 of the transfer sheet P, simply solve the equivalent circuit for the potential difference V across C4, using the value of the electric charge (potential) caused by Paschen's discharge as the initial potential. The final charged potential V of C4 is determined, with Paschen's discharge and the electric charge injection taken into consideration. The analytic equation for the final charged potential V determined in this manner is:

$$V=A\times(\beta\times e^{B}-\gamma\times e^{C}) \quad \ldots (1)$$

wherein A, B, C, β and γ are constants dependent to the circuit.

In this manner, the electric charge (potential) stored on the transfer sheet P shows a polarity opposite to that of the voltage applied to the conductive layer 26. Therefore, an electrostatic attracting force is generated between the transfer sheet P and the conductive layer 26, attracting the transfer sheet P onto the transfer drum 11. In other words, the higher the charged potential on the transfer sheet P becomes, the stronger the electrostatic attracting force that attracts the transfer sheet P onto the transfer drum 11, i.e., the electrostatic attracting force, becomes.

Generally the electrostatic attracting force F is given by the equation:

$$F=q\times E=q\times\frac{V}{d} \quad (2)$$

Therefore, the electrostatic attracting force F is proportional to the electric charge q and the final charged potential V, and increases with an increase in the values thereof. The circuit shown in FIG. 6 indicates that the lower the resistance value r1 of the pressure conductive layer 27 is, the more electric charge flows into the transfer sheet P. It is thus concluded that the lower the resistance value r1 of the pressure conductive layer 27 is, the stronger attracting force F can be applied to the transfer sheet P.

Figure 7:
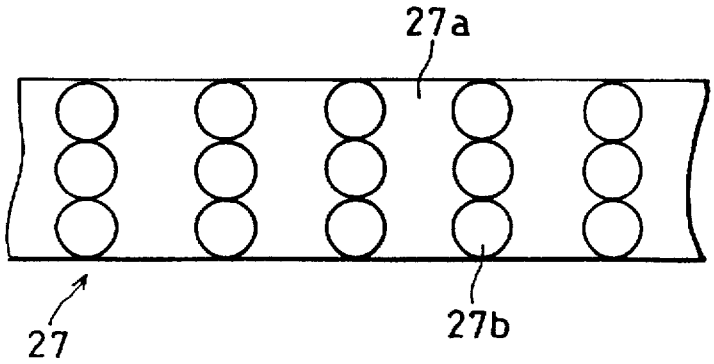
FIG. 7 is a cross-sectional view showing a configuration of a pressure conductive layer of the transfer drum shown in FIG. 2.

The pressure conductive layer 27 is a layer made of a substance having a property that the volume resistivity falls as a pressure is applied. The pressure conductive layer 27, as shown in FIG. 7, is an anisotropic conductive connector which includes gold-plated metal particles 27*b* arranged in a conductive rubber 27*a*, and has a property that the resistance falls as a pressure is applied.

Any segment of the pressure conductive rubber forming the pressure conductive layer 27 is compressed and alters its volume resistivity by the application of pressure. The volume resistivity of the pressure conductive layer 27 during pressurization is adjusted by scattering metal powder having a small diameter in the material such as urethane rubber.

The conductive rubber 27*a* is an elastic semiconductive material composed of powder-like conductive substance scattered in rubber. Examples of the rubber used here include a foamed urethane rubber and elastomer; however, a foamed urethane rubber is especially preferred. Examples of the conductive substance used here include carbon black and iron powder; however, iron powder is especially preferred.

Any segment of the conductive rubber 27*a* is compressed, but does not alter its volume resistivity by the application of pressure. The volume resistivity of the conductive rubber 27a is equal to that of the material such as urethane rubber, because no metal powder is scattered in the material.

The hardness of the conductive rubber 27a is preferably in a range of 25 degrees to 50 degrees in Asker C. This improves the quality of the transferred image and the attraction of the transfer sheet.

Asker C is a hardness standard of Japanese Rubber Association. A needle with a round tip for use in measuring hardness is pressed against the surface of a sample with a force of a spring. According to Asker C, hardness is expressed as depth (push-in depth) by which the needle pushes in the sample when a resistant force of the sample and the force of the spring are balanced. The 0 degree of Asker C hardness represents the hardness of the sample that the push-in depth of the needle equals the maximum shift of the needle when a weight of 55 g is given to the spring, whereas the 100 degree of Asker C hardness represents the hardness of the sample that the push-in depth of the needle equals the maximum shift of the needle when a weight of 855 g is given to the spring.

Iron powder is a preferred example of the pressure conductive layer 27. Note that in the present embodiment the metal particles 27b are plated with gold to enhance stability of the volume resistivity of the pressure conductive layer 27 over a long period of time. However, the metal particles 27b are not necessarily plated with gold.

The average particle diameter of the metal particles 27b only needs to be in a range in which the press conductivity of the pressure conductive layer 27 is preserved; however, it is preferably in a range of 5 μm to 20 μm. If the average particle diameter of the metal particles 27b is less than 5 μm, the volume resistivity of the pressure conductive layer 27 changes by too small an amount in response to a change in the pressure applied to the pressure conductive layer 27. Consequently, in some cases, it is difficult to change the volume resistivity of the pressure conductive layer 27 in a desired range. On the other hand, if the average particle diameter of the metal particles 27b is more than 20 μm, the volume resistivity of the pressure conductive layer 27 may possibly be too small.

The ratio of the metal particles 27b to the pressure conductive layer 27 is preferably 5 to 10 weight percent. If the pressure conductive layer 27 contains less than 5 weight percent of the metal particles 27b, the volume resistivity of the pressure conductive layer 27 changes by too small an amount in response to a change in the pressure applied to the pressure conductive layer 27. Consequently, in some cases, it is difficult to change the volume resistivity of the pressure conductive layer 27 in a desired range. On the other hand, if the pressure conductive layer 27 contains more than 10 weight percent of metal particles 27b, the volume resistivity of the pressure conductive layer 27 may possibly be too small.

The pressure conductive layer 27 is preferably a pressure conductive sheet whose volume resistivity changes in the range of $10^{10}$ω·cm to $10^{7}$ω·cm when the applied pressure changes in the range of 100 g/cm$^2$ to 1000 g/cm$^2$. This can prevent an inappropriate toner transfer, while preventing inappropriate electrostatic attraction of the transfer sheet. The pressure conductive layer 27 preferably has a thickness in a range of 2 to 5 mm.

Table 1 shows results of tests checking the attraction of the transfer sheet (transfer material) P while varying the volume resistivity of the pressure conductive layer 27.

[TABLE 1]

| Volume resistivity (Ω · cm) | ATTRACTION OF TRANSFER SHEET P |
|---|---|
| $10^5$ or smaller | Poor |
| $10^6$ | Normal |
| $10^7$ | Good |
| $10^8$ | Good |
| $10^9$ | Good |
| $10^{10}$ | Normal |
| $10^{11}$ or larger | Poor |

In Table 1, "Good" rating represents that the attraction of the transfer sheet P is good, and that the transfer sheet P is stably attracted onto the transfer drum 11 during the four rotations of the transfer drum 11 (transfers of the toner of the four colors). "Normal" rating represents that the attraction of the transfer sheet P is normal, and that the transfer sheet P is stably attracted onto the transfer drum 11 during the four rotations of the transfer drum 11, but the leading or trailing edge of the transfer sheet P is not attracted properly to the transfer drum 11. "Poor" rating represents that the attraction of the transfer sheet P is poor, and that the transfer sheet P comes off the transfer drum 11 before the transfer drum 11 completes the four rotations.

Table 1 shows that effective volume resistivities of the pressure conductive layer 27 in electrostatically attracting the transfer sheet P properly are $10^{10}$ω·cm to $10^{6}$ω·cm. If the volume resistivity of the pressure conductive layer 27 is smaller than $10^{6}$ω·cm, especially if smaller than $10^{5}$ω·cm, the contact pressure is too high. Consequently, the transfer sheet P is not attracted properly along the transfer drum 11 and curls in the opposite direction, causing inappropriate attraction of the transfer sheet P. On the other hand, if the volume resistivity of the pressure conductive layer 27 is larger than $10^{10}$ω·cm, especially if larger than $10^{11}$ω·cm, the volume resistivity is too high and reduces the charged potential, causing inappropriate attraction of the transfer sheet P. Note also that Table 1 shows the results of the tests obtained with all possible materials used as the transfer sheet P, the range including attracting properties of paper, an OHP sheet and the like.

Table 2 shows results of tests checking the quality of images toner-transferred from the photoconductor drum 15 onto the transfer sheet P while varying the volume resistivity of the pressure conductive layer 27.

[TABLE 2]

| Volume resistivity (Ω · cm) | QUALITY OF IMAGE |
|---|---|
| $10^5$ or smaller | Poor |
| $10^6$ | Normal |
| $10^7$ | Good |
| $10^8$ | Good |
| $10^9$ | Good |
| $10^{10}$ | Normal |
| $10^{11}$ or larger | Poor |

In Table 2, "Good" rating represents that the transfer from the photoconductor drum 15 onto the transfer sheet P is good, and that the quality of the image formed on the transfer sheet P is good. "Normal" rating represents that the transfer from the photoconductor drum 15 onto the transfer sheet P is normal, and that the quality of the image formed on the transfer sheet P is normal. "Poor" rating represents that the transfer from the photoconductor drum 15 onto the transfer sheet P is poor, and that the quality of the image formed on the transfer sheet P is poor.

Table 2 shows that effective volume resistivities of the pressure conductive layer 27 in performing a toner transfer are $10^7$ω·cm to $10^{11}$ω·cm. If the volume resistivity of the pressure conductive layer 27 is smaller than $10^7$ω·cm, especially if smaller than $10^6$ω·cm, too large an electric current flows between the photoconductor drum 15 and the transfer drum 11 during the transfer, causing a reverse transfer. On the other hand, if the volume resistivity of the pressure conductive layer 27 is larger than $10^{11}$ω·cm especially if larger than $10^{12}$ω·cm, a transfer current of an amount required for a good transfer does not flow between the photoconductor drum 15 and the transfer drum 11, causing an inappropriate transfer. Note also that Table 2 shows the results of the tests obtained with all kinds of transfer sheets (transfer materials) P for performing a toner transfer, the range including attracting properties of paper, an OHP sheet or the like.

The above results show that the pressure conductive layer 27 which is variable (adjustable) at least in a range of $10^6$ω·cm to $10^{11}$ω·cm is needed to either electrostatically attract the transfer sheet P or perform a toner transfer properly, and that the pressure conductive layer 27 which is variable in a range of $10^7$ω·cm to $10^{10}$ω·cm serves the need to both electrostatically attract the transfer sheet P and perform a toner transfer properly.

In other words, the volume resistivity of the pressure conductive layer 27 for both electrostatically attracting the transfer sheet P and performing a toner transfer properly can be obtained by independently adjusting the contact pressure between the ground roller 12 and the transfer drum 11 and the contact pressure between the photoconductor drum 15 and the transfer drum 11 so that the volume resistivity falls in the range of $10^7$ω·cm to $10^{10}$ω·cm.

Tables 1 and 2 also shows that the advantageous volume resistivity of the pressure conductive layer 27 for electrostatically attracting the transfer sheet P properly is relatively small, and that the advantageous volume resistivity of the pressure conductive layer 27 for performing a toner transfer properly is relatively large.

Consequently, the contact pressure between the ground roller 12 and the transfer drum 11 is preferably set to be larger than that between the photoconductor drum 15 and the transfer drum 11.

The contact pressure between the ground roller 12 and the transfer drum 11 is adjusted by a contact pressure adjusting section (contact pressure adjusting means). As shown in FIGS. 8 and 9, the contact pressure adjusting section in the present embodiment includes the eccentric cum 34, disposed under the ground roller 12, for pressing the ground roller 12 toward the transfer drum 11, and a drive section (not shown) for driving the eccentric cum 34, to change the force of the eccentric cum 34 pressing the ground roller 12.

The eccentric cam 34 is composed of an axis **34*a* and two press members 34*b* made of flat plate of the same elliptic shape. The press members 34*b* are disposed at each end of the axis 34*a*. The eccentric cam 34 is disposed so that the press members 34*b* contact a rotation axis 12*a* of the ground roller 12 which extends in axial directions from the center of both side surfaces of the ground roller 12 with respect to its axial directions. The axis 34*a* is configured to support the press members 34*b* at a point downwardly off the center of the press members 34*b*, and to be parallel to the rotation axis 12*a* of the ground roller 12**.

Figure 9:
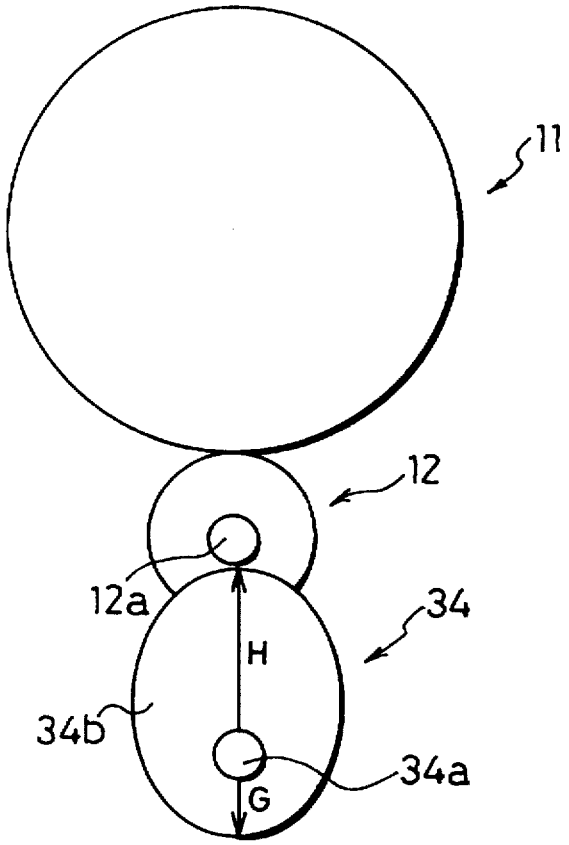
FIG. 9 is a side view showing the contact pressure adjusting section shown in FIG. 8.

As shown in FIG. 9 illustrating a side view of the transfer drum 11, ground roller 12 and eccentric cam 34, the contact pressure between the transfer drum 11 and the ground roller 12 is the largest when the distance between the axis **34*a* and the rotation axis 12*a* is the longest (when the distance from the axis 34*a* to the edge of the press member 34*b* equals H in FIG. 9), and is the smallest when the distance between the axis 34*a* and the rotation axis 12*a* is the shortest (when the distance from the axis 34*a* to the edge of the press member 34*b* equals G in FIG. 9**).

The drive section adjusts the distance between the axis **34*a* and the rotation axis 12*a* by rotating the axis 34*a* by a predetermined angle according to information on the kind of the transfer sheet (material, thickness, etc.) sensed by the transfer sheet sensor 33, and thereby adjusts the force of the eccentric cam 34 pressing the ground roller 12**.

In this manner, the contact pressure adjusting section adjusts the force of the eccentric cam 34 pressing the ground roller 12 by rotating the eccentric cam 34 according to information on the kind of the transfer sheet (material, thickness, etc.) sensed by the transfer sheet sensor 33, and thereby adjusts the contact force between the transfer drum 11 and the ground roller 12. The press member **34*b* is not limited in a particular manner as long as the portion thereof that contacts the rotation axis 12*a*** (i.e., the edge portion thereof) is bordered by a curved line, and may take, for example, a circular shape and a globular shape.

The following description will explain the charged potential that varies depending upon the kind of the transfer sheets P.

Figure 10:
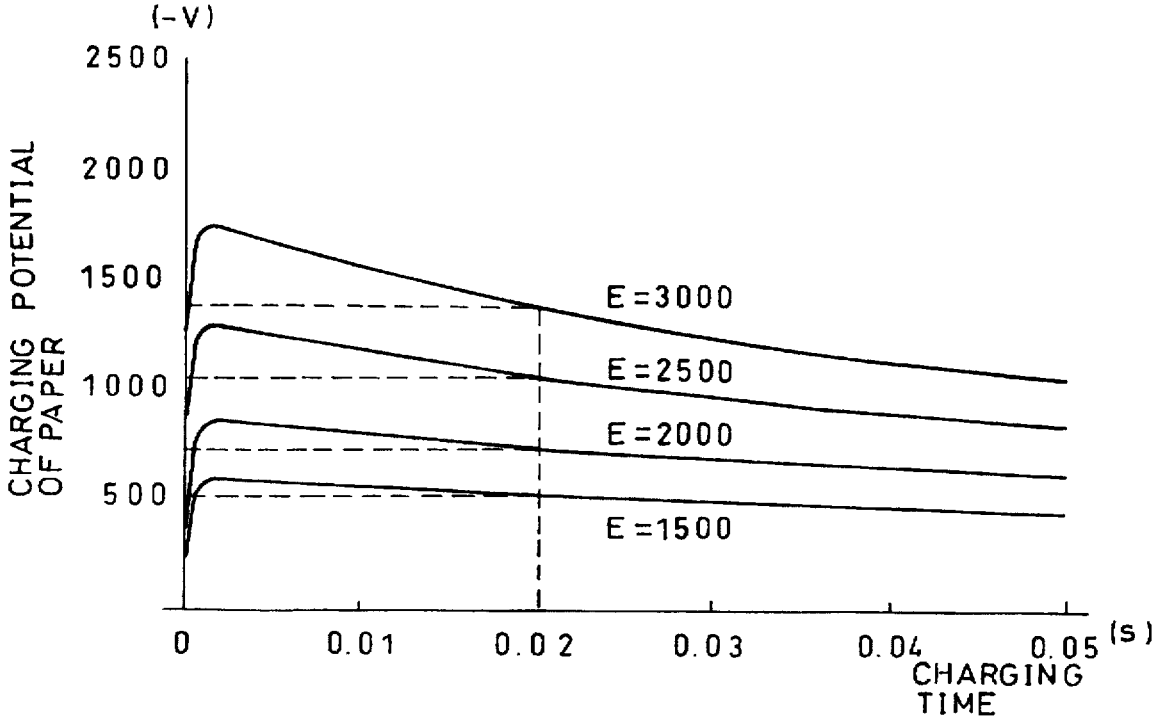
FIG. 10 is a graph showing correlation between the charging time and the charged potential of a transfer sheet P when the volume resistivity of the pressure conductive layer of the transfer drum shown in FIG. 2 is $10^8\omega\cdot cm$ and the transfer sheet P is paper.

Charged potentials of the transfer sheet P were theoretically calculated, using Eq. (1) that takes account of the amount of the electric charge injection during the charging time (nip time), under the conditions that paper is used as the transfer sheet P, the volume resistivity of the dielectric layer (polyvinylidene fluoride) 28 is $10^{12}$ω·cm, and the volume resistivity of the pressure conductive layer 27 is $10^8$ω·cm. FIG. 10 shows how those calculated charged potentials of the transfer sheet P vary depending upon the charging time.

The charging time (nip time) here refers to a time during which a certain point on the transfer sheet P passes through the nip between the ground roller 12 and the transfer drum 11 (the portion where the ground roller 12 firmly contacts the transfer drum 11). Supposing that various physical properties and location of the transfer drum 11 do not change (In fact, the volume resistivity of the pressure conductive layer 27 does change), the charging time (nip time) is determined by the rotational speed and the contact pressure between the transfer drum 11 and the ground roller 12.

Figure 11:
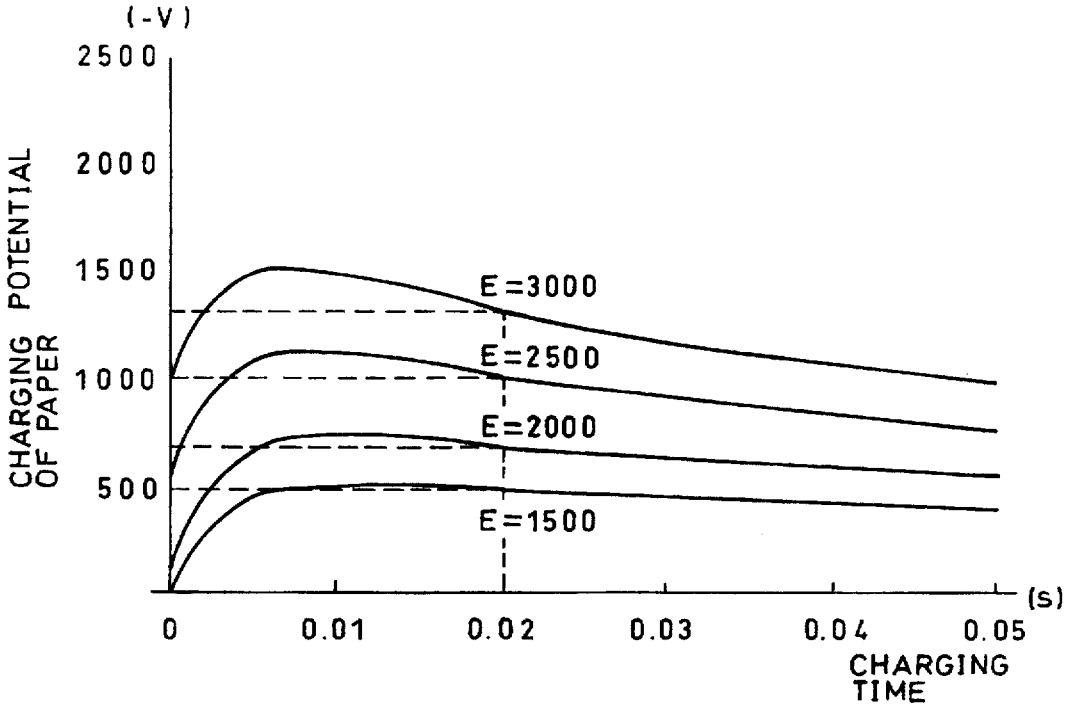
FIG. 11 is a graph showing correlation between the charging time and the charged potential of a transfer sheet P when the volume resistivity of the pressure conductive layer of the transfer drum shown in FIG. 2 is $10^9\omega\cdot cm$ and the transfer sheet P is paper.

Charged potentials of the transfer sheet P were theoretically calculated, using Eq. (1) that takes account of the amount of the electric charge injection during the charging time, under the conditions that paper is used as the transfer sheet P, the volume resistivity of the dielectric layer (polyvinylidene fluoride) 28 is $10^{12}$ω·cm, and the volume resistivity of the pressure conductive layer 27 is $10^9$ω·cm. FIG. 11 shows how those calculated charged potentials of the transfer sheet P vary depending upon the charging time.

Figure 12:
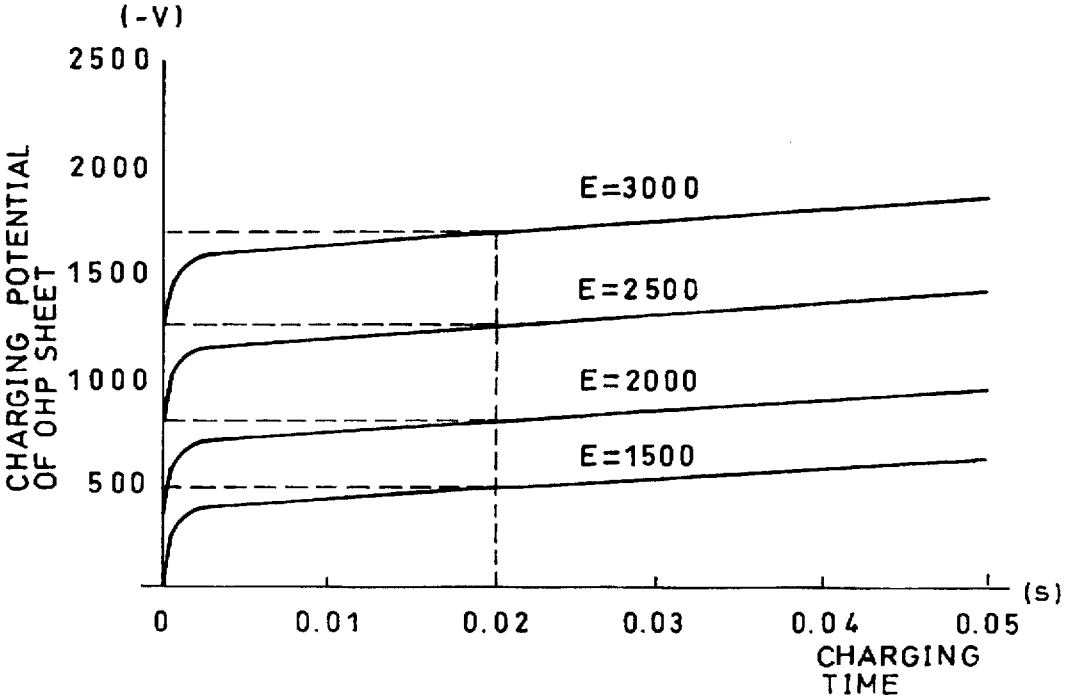
FIG. 12 is a graph showing correlation between the charging time and the charged potential of a transfer sheet P when the volume resistivity of the pressure conductive layer of the transfer drum shown in FIG. 2 is $10^8\omega\cdot cm$ and the transfer sheet P is an OHP sheet (sheet made of synthetic resin for use with an overhead projector).

Charged potentials of the transfer sheet P were theoretically calculated, using Eq. (1) that takes account of the amount of the electric charge injection during the charging time, under the conditions that an OHP sheet is used as the transfer sheet P, the volume resistivity of the dielectric layer (polyvinylidene fluoride) 28 is $10^{12}$ω·cm, and the volume resistivity of the pressure conductive layer 27 is $10^8$ω·cm. FIG. 12 shows how those calculated charged potentials of the transfer sheet P vary depending upon the charging time.

Figure 13:
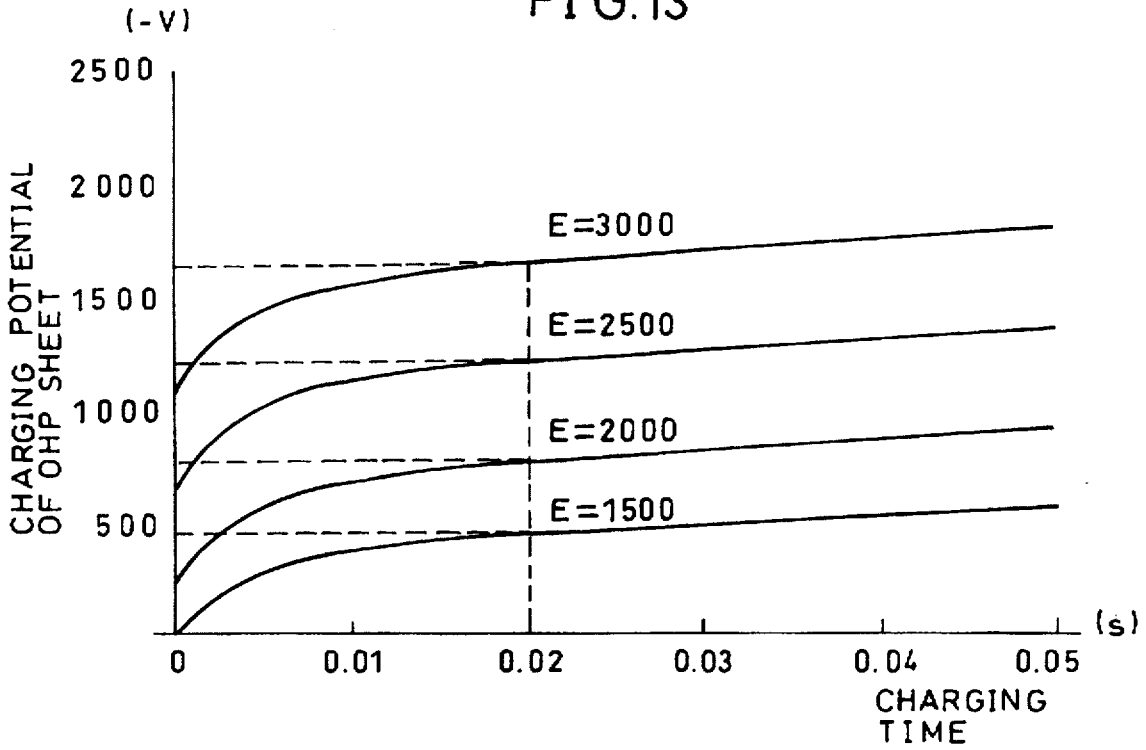
FIG. 13 is a graph showing correlation between the charging time and the charged potential of a transfer sheet P when the volume resistivity of the pressure conductive layer of the transfer drum shown in FIG. 2 is $10^9\omega\cdot cm$ and the transfer sheet P is an OHP sheet (sheet made of synthetic resin for use with an overhead projector).

Charged potentials of the transfer sheet P were theoretically calculated, using Eq. (1) that takes account of the amount of the electric charge injection during the charging time, under the conditions that an OHP sheet is used as the transfer sheet P, the volume resistivity of the dielectric layer (polyvinylidene fluoride) 28 is $10^{12}$ω·cm, and the volume resistivity of the pressure conductive layer 27 is $10^9$ω·cm. FIG. 13 shows how those calculated charged potentials of the transfer sheet P vary depending upon the charging time.

The curved lines marked as "E=3000", "E=2500", "E=2000", "E=1500" shown in FIGS. 10 through 13 represent cases in which the applied voltage E to the conductive layer 26 is 3000 V, 2500 V, 2000 V and 1500 V respectively.

A comparison of either FIGS. 10 and 11 or FIGS. 12 and 13 shows that even if the transfer sheets P of the same kind are used, the pressure conductive layer 27 of a lower volume resistivity produces a higher charged potential during a certain period of time than that of a higher volume resistivity (e.g., the charged potential for a charging time of 0.02 second). Accordingly, it is understood that the pressure conductive layer 27 having a lower volume resistivity is more effective to electrostatically attract the transfer sheet P. This result obtained from the analysis coincides with the result obtained from the tests.

A comparison of either FIGS. 10 and 12 or FIGS. 11 and 13 shows that even if the pressure conductive layers 27 of the same volume resistivity are used, the different kinds of transfer sheets P result in different tendencies in charged potentials thereof. For example, a comparison of FIGS. 10 and 12 shows that under the conditions that the volume resistivity of the pressure conductive layer 27 is $10^8$ω·cm, the applied voltage to the conductive layer 26 is 3000 V, and the charging time is 0.02 second, the charged potential of the transfer sheet P is about 1300 V if the transfer sheet P is paper and is about 1700 V if the transfer sheet P is an OHP sheet.

As described above, even if pressure conductive layers 27 of the same volume resistivity are used, the charged potential of the transfer sheet P varies depending upon the material of the transfer sheet P, and therefore the electrostatic attracting force of the transfer sheet P onto the transfer drum 11 also varies depending upon the material of the transfer sheet P. It is also known that the electrostatic attracting force of the transfer sheet P onto the transfer drum 11 also varies depending upon the thickness of the transfer sheet P.

For these reasons, in the present embodiment, the contact pressure adjusting section adjusts the contact pressure between the transfer drum 11 and the ground roller 12 according to the kind of the transfer sheet P sensed by the transfer sheet sensor 33, and changes the volume resistivity of the pressure conductive layer 27. This enables the transfer sheet P to be electrostatically attracted more effectively.

More specifically, in the present embodiment, the transfer sheet sensor 33 shown in FIG. 2 senses a difference in the material, for example, distinguishes between paper and an OHP sheet by measuring transmittances, or between a thin sheet of paper and a thick sheet of paper by sensing the thicknesses of the transfer sheet P. Then, the contact pressure adjusting section adjusts the contact pressure (nip pressure) of the ground roller 12, using the eccentric cum 34, according to the sensed kind of the transfer sheet P (for example, the material such as paper or a OHP sheet, and the thickness of the transfer sheet P) so as to adjust the charged potential of the transfer sheet P to be appropriate to the kind of the transfer sheet P.

As described so far, the image forming apparatus of the present embodiment includes:

- a photoconductor drum 15 on whose surface a toner image is formed,
- a transfer drum 11, including a dielectric layer 28, a pressure conductive layer 27 whose volume resistivity falls by the application of pressure, and a conductive layer 26 stacked in this order from the surface of the transfer drum 11, for transferring the toner image formed on the photoconductor drum 15 onto the transfer sheet P by electrically attracting and holding the transfer sheet P onto the surface of the dielectric layer 28 and by bringing the transfer sheet P into contact with the photoconductor drum 15,
- a power source section 32 for applying the first voltage to the conductive layer 26, and
- a ground roller (contact and charge member) 12 for coming into contact with the surface of the dielectric layer 28 via the transfer sheet P and for charging the transfer sheet P.

According to the configuration, it is possible to adjust the volume resistivity of the pressure conductive layer 27 provided between the dielectric layer 28 and the conductive layer 26 by adjusting the contact pressure between the transfer drum 11 and the ground roller 12, and to adjust the amount of electric charge injected to the transfer sheet P. Accordingly, even if a transfer sheet P of a different kind is used, it is possible to always maintain the amount of electric charge injected to the transfer sheet P at an optimum value by adjusting the contact pressure between the transfer drum 11 and the ground roller 12. As a result, it is possible to electrostatically attract the transfer sheet P onto the transfer drum 11 stably, regardless of the kind of the transfer sheet P.

The configuration of the present embodiment has also the following advantage: According to the configuration of the present embodiment, the pressure conductive layer 27 stores electric charge with the application of a voltage to the conductive layer 26. The electric charge stored in the pressure conductive layer 27 moves via the dielectric layer 28 to the inner side of the transfer sheet P, then to the surface of the transfer sheet P, by bringing the grounded ground roller 12 into contact with the dielectric layer 28 via the transfer sheet P. The transfer sheet P can be electrostatically attracted onto the surface of the transfer drum 11 in this manner. The toner transfer can also be performed, using the voltage applied to the conductive layer 26 by the power source section 32 for performing the electrostatic attraction of the transfer sheet P.

Conventionally the toner transfer and the attraction of the transfer sheet are performed by an atmospheric discharge. By contrast, according to the configuration of the present embodiment as described above, the toner transfer and the attraction of the transfer sheet P are performed by the injection of electric charge. Therefore, it is possible to lower the voltage applied to the conductive layer 26, to easily control the voltage, and to restrain generation of ozone. It is also possible to surely and stably perform the toner transfer and the electrostatic attraction of the transfer sheet P with the common power source section 32.

The image forming apparatus of the present embodiment further includes a transfer sheet sensor (transfer material sensing means) 33 for sensing the kind of the transfer sheet P, and contact pressure adjusting section for adjusting the contact pressure of the ground roller 12 and the transfer drum 11 according to a result of the sensing by the transfer sheet sensor 33.

By adjusting the contact pressure between the ground roller 12 and the transfer drum 11 according to the kind of the transfer sheet P in this manner, the amount of electric charge required for the electrostatic attraction of the transfer sheet P can be adjusted. This makes it possible to surely perform the electrostatic attraction of various kinds of transfer sheets P onto the transfer drum 11, and stably perform the image forming.

In addition, with the image forming apparatus of the present embodiment, the contact pressure between the ground roller 12 and the transfer drum 11 is set to be larger than that between the photoconductor drum 15 and the transfer drum 11.

This makes the volume resistivity of the pressure conductive layer 27 between the photoconductor drum 15 and the transfer drum 11 is set to be larger than that of the pressure conductive layer 27 between the ground roller 12 and the transfer drum 11. Consequently, the optimum current control for the toner transfer and the optimum charged potential for the electrostatic attraction of the transfer sheet P can be performed by a simple control of controlling a single power source.

The image forming apparatus of the present embodiment is configured so that the contact pressure adjusting section adjusts the contact pressure between the ground roller 12 and the transfer drum 11 according to the kind of the transfer sheet P sensed by the transfer sheet sensor 33. However, the image forming apparatus of the present embodiment could be configured so that it includes a sensor for sensing environmental conditions (e.g., temperature and humidity) around the transfer drum 11, and the contact pressure adjusting section adjusts the contact pressure between the ground roller 12 and the transfer drum 11 according to the environmental conditions sensed by that sensor.

[Second Embodiment]

Figure 14:
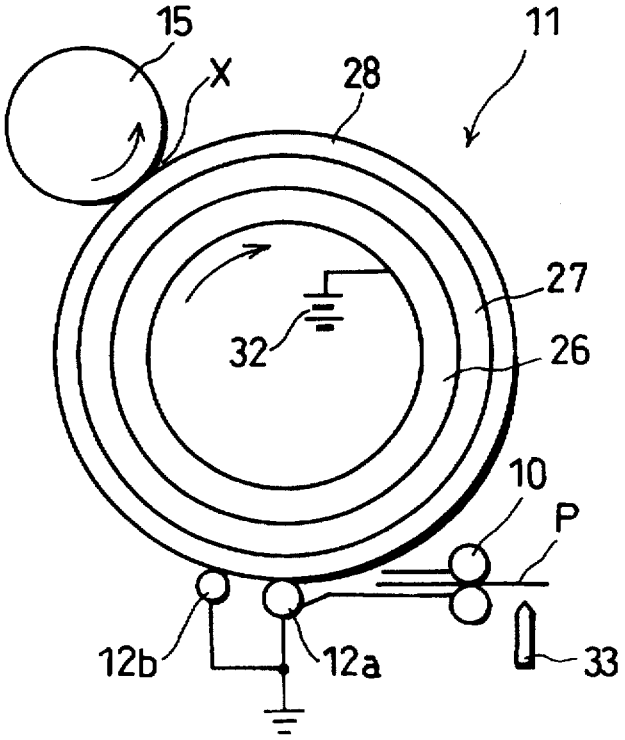
FIG. 14 is a cross-sectional view showing an image forming apparatus of another embodiment in accordance with the present invention.

Referring to FIG. 14, the following description will discuss another embodiment in accordance with the present invention. Here, for convenience, members of the second embodiment that have the same arrangement and function as members of the first embodiment, and that are mentioned in the first embodiment are indicated by the same reference numerals and description thereof is omitted.

The image forming apparatus of the present embodiment, as shown in FIG. 14, includes two ground rollers **12*a* and 12*b* in lieu of the ground roller 12 of the first embodiment. The contact pressure between the ground roller 12*a* and the transfer drum 11 and the contact pressure between the ground roller 12*b* and the transfer drum 11** are independently adjustable.

By independently adjusting the contact pressures of the ground roller **12*a* and the ground roller 12*b* in this manner, an effective charged potential in electrostatically attracting the transfer sheet P can be always given to the transfer sheet P according to the kind of the transfer sheet P sensed by the transfer sheet sensor 33. As a result, the transfer sheet P is surely electrostatically attracted onto the transfer drum 11** regardless of the kind of the transfer sheet P, and the image forming is performed stably.

In addition, even if the contact pressure between the ground roller **12*a* and the transfer drum 11 and the contact pressure between the ground roller 12*b* and the transfer drum 11 are lowered, a high charged potential can be obtained with the configuration of the present embodiment, compared to a case in which only one ground roller 12** is used.

More specifically, since the ground rollers **12*a* and 12*b* contacts the transfer drum 11 at two different places thereon, when the volume resistivity of the pressure conductive layer 27 is lowered so as to raise the charged potential of the transfer sheet P, the contact pressures between the transfer drum 11 and the ground rollers 12*a* and 12*b* do not need to be as high as that between the transfer drum 11 and the single ground roller 12, and can be further lowered. This can prevent reverse curling, in which the transfer sheet P curls reversely to the direction along the transfer drum 11**.

Although two ground rollers are explained in the above description, three or more rollers may be used. Besides, an effective charged potential in electrostatically attracting the transfer sheet P of any kind may be realized by independently adjusting the contact pressures between the transfer drum 11 and the two ground rollers **12*a* and 12*b* according to the kind of the transfer sheet P. In addition, the pressures between the transfer drum 11 and the two ground rollers 12*a* and 12*b*** may be independently controlled according to sensed environmental conditions (e.g., temperature and humidity), as well as the kind of the transfer sheet P.

Also, the ground rollers (12, **12*a* and 12*b***) are used as the first electrode member in the first and second embodiments above. However, the first electrode only needs to be conductive. Other kind of components such as a conductive roller-shaped brush and a conductive combshaped brush could be also used.

[Third Embodiment]

Figure 15:
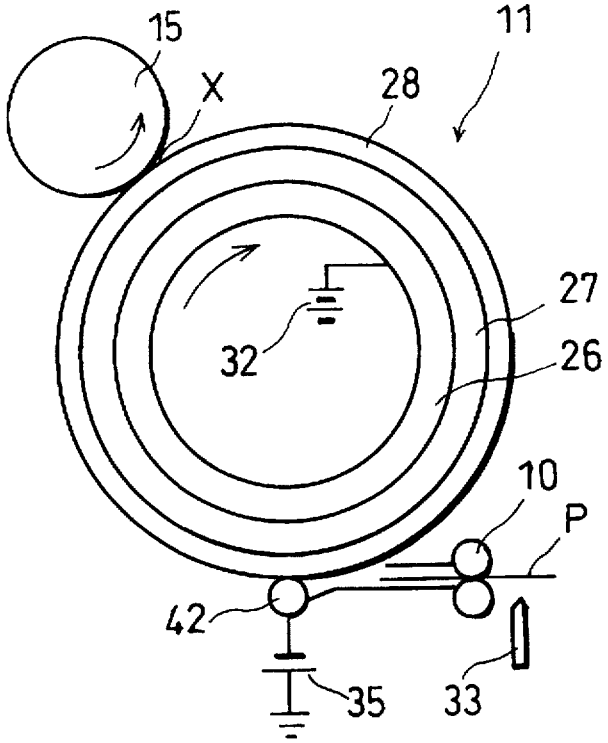
FIG. 15 is a cross-sectional view showing an image forming apparatus of even another embodiment in accordance with the present invention.

Referring to FIG. 15, the following description will discuss even another embodiment in accordance with the present invention. Here, for convenience, members of the third embodiment that have the same arrangement and function as members of the first embodiment, and that are mentioned in the first embodiment are indicated by the same reference numerals and description thereof is omitted.

In the same manner as the configuration of the first embodiment, the image forming apparatus of the present embodiment, as shown in FIG. 15, is composed of a photoconductor drum 15 on which a toner image is formed, a pre-curl roller 10 for providing the transfer sheet P with curvature, a transfer drum 11 for rotating at a predetermined rotational speed while electrically attracting and holding the transfer sheet P provided with curvature, and for transferring the toner image formed on the photoconductor drum 15 by pressing the transfer sheet P onto the photoconductor drum 15, a roller (second electrode member) 42, disposed on the upstream side of the transfer position of a toner image onto the transfer sheet P on the transfer drum 11, for contacting the surface of the dielectric layer 28 of the transfer drum 11 via the transfer sheet P, a power source supplying section 32 for applying a predetermined voltage to the conductive layer 26 of the transfer drum 11, a discharger **11*a* for discharging the dielectric layer 28 of the transfer drum 11, and a cleaner 11*b* for removing the toner on the dielectric layer 28 of the transfer drum 11. The conductive layer 26, pressure conductive layer 27 and dielectric layer 28 are stacked on the transfer drum 11 in this order outwardly from the surface of the transfer drum 11**.

The roller 42 of the present embodiment is connected to a power source 35, whereas the conductive ground roller 12 of the first embodiment is grounded. The power source 35 is connected to the roller 42 in the same direction as the power source supplying section 32 that provides a power source to the transfer drum 11, so as to apply a negative voltage to the roller 42, which has the polarity opposite to that of the positive voltage applied to the conductive layer 26.

The roller 42 is an electrode member made of a conductive material as is the ground roller 12, and is pressed to the surface of the transfer drum 11 via the transfer sheet P by the eccentric cum 34.

Applying to the roller 42 a negative voltage having the polarity opposite to that of the voltage applied to the conductive layer 26 enables the pressure conductive layer 27 to store a larger amount of electric charge, and enables this dielectric layer and the roller to come in contact via the transfer sheet P. As a result, the electric charge stored in the pressure conductive layer 27 in a larger amount moves via the dielectric layer 28 to the inner side of the transfer sheet P, then to the surface of the transfer sheet P, electrostatically attracting the transfer sheet P onto the surface of the transfer drum 11 more stably. Consequently, the image forming can be stably performed.

In other words, in the present embodiment, the charged potential of the transfer sheet P can be raised with the applied voltage to the roller 42, while maintaining the transfer voltage of the toner. This allows the charged potential of the transfer sheet P to be raised, and the transfer sheet P to be electrostatically attracted onto the transfer drum 11 effectively, compared to the configurations of the first and second embodiments.

Moreover, the image forming apparatus of the present embodiment is preferably provided with a contact pressure and voltage adjusting section (contact pressure and voltage adjusting means) for adjusting the contact pressure between the roller 42 and the transfer drum 11 and the voltage supplied to the roller 42, in lieu of the contact pressure adjusting section of the first embodiment. This allows the electrostatic attraction of the transfer sheet P onto the transfer drum 11 to be controlled with both the contact pressure between the roller 42 and the transfer drum 11 and the voltage supplied to the roller 42, enabling the electrostatic attraction to be performed more stably.

Besides, the power source 35 is connected to the roller 42 separately from the power source supplying section 32 to perform the toner transfer and the electrostatic attraction of the transfer sheet P onto the transfer drum 11 with the separate power source supplying section 32 and power source 35. Therefore, the toner transfer and the electrostatic attraction of the transfer sheet P onto the transfer drum 11 can be performed properly regardless of the kind of the transfer sheet P and environments, enabling the image forming to be performed stably.

[Fourth Embodiment]

Figure 16:
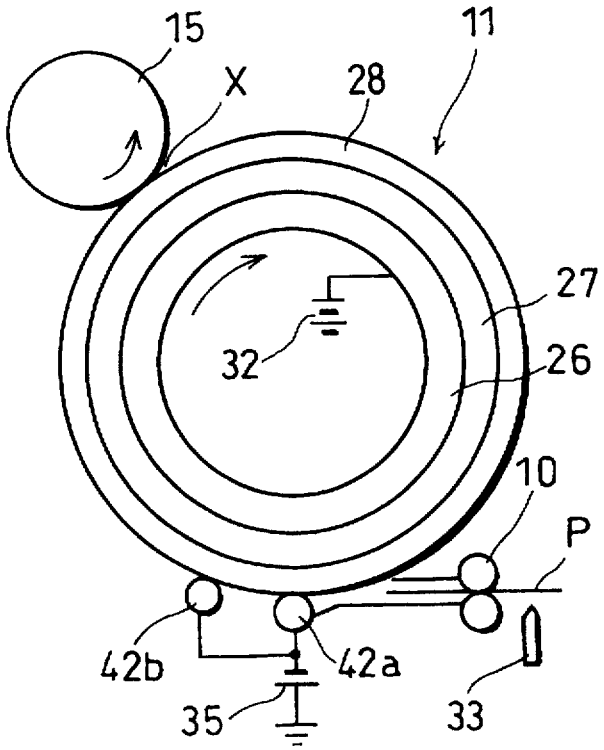
FIG. 16 is a cross-sectional view showing an image forming apparatus of still another embodiment in accordance with the present invention.

Referring to FIG. 16, the following description will discuss still another embodiment in accordance with the present invention. Here, for convenience, members of the fourth embodiment that have the same arrangement and function as members of the third embodiment, and that are mentioned in the third embodiment are indicated by the same reference numerals and description thereof is omitted.

The image forming apparatus of the present embodiment, as shown in FIG. 16, includes two ground rollers **42*a* and 42*b*, in lieu of the ground roller 42 of the third embodiment, and applies a common voltage to the ground rollers 42*a* and 42*b* with the power source 35. The contact pressure between the transfer drum 11 and the ground rollers 42*a* and 42*b* and the voltage supplied to the ground rollers 42*a* and 42*b*** are independently adjustable.

Besides, the image forming apparatus of the present embodiment is preferably provided with the same contact pressure and voltage adjusting section as that of the third embodiment, so as to adjust the contact pressure between the second electrode members and the transfer means and the second voltage supplied to the second electrode members.

This produces the effects of the second and third embodiments. Consequently, the toner transfer and the electrostatic attraction of the transfer sheet P onto the transfer drum 11 is be more surely performed, enabling the image forming to be performed more stably.

[Fifth Embodiment]

Figure 17:
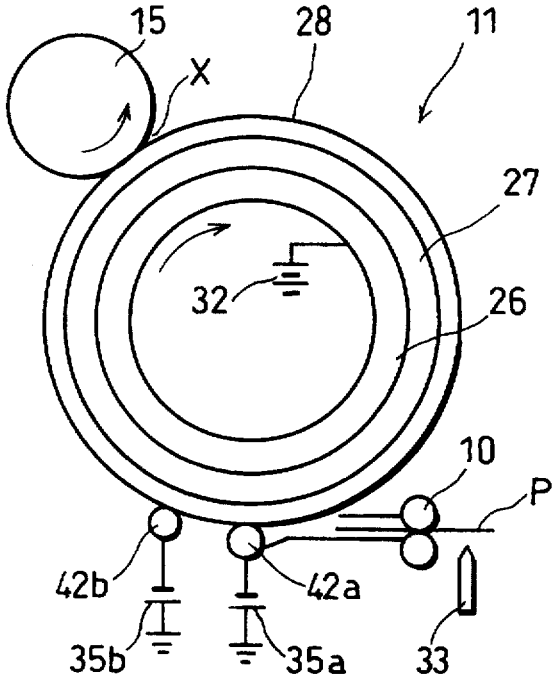
FIG. 17 is a cross-sectional view showing an image forming apparatus of yet another embodiment in accordance with the present invention.

Referring to FIG. 17, the following description will discuss yet another embodiment in accordance with the present invention. Here, for convenience, members of the fifth embodiment that have the same arrangement and function as members of the fourth embodiment, and that are mentioned in the fourth embodiment are indicated by the same reference numerals and description thereof is omitted.

As shown in FIG. 17, the image forming apparatus of the present embodiment includes two power sources **35*a* and 35*b*, in lieu of the power source 35 of the fourth embodiment, that are respectively connected to the ground rollers 42*a* and 42*b* to apply respective voltages to the ground rollers 42*a* and 42*b***. The configuration produces the same effects as the fourth embodiment.

Note that the roller 42 is used as the second electrode member in the configurations of the third, fourth and fifth embodiments. However, the second electrode only needs to be conductive. Other kinds of component such as a conductive roller-shaped brush or a conductive comb-shaped brush could be also used.

The dielectric layer 28 of the transfer drum 11 of the first through fifth embodiments are preferably a cylindrical seamless thin film sheet and are fixed onto the pressure conductive layer 27 with a heat shrinking method. This firmly fixes the dielectric layer 28 to the pressure conductive layer 27, and prevents a hollow space from growing between the dielectric layer 28 and the pressure conductive layer 27 that is an unstable element in transferring toner and electrostatically attracting the transfer sheet P onto the transfer drum 11, enabling stable toner transfer and electrostatic attraction of the transfer sheet P onto the transfer drum 11.

Figure 18:
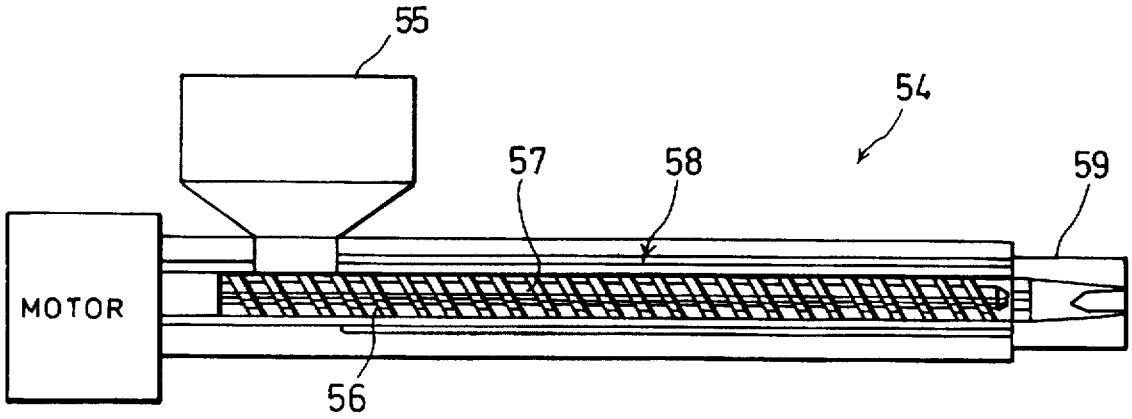
FIG. 18 is a cross-sectional view showing a push-out machine for forming a circular seamless thin film sheet for use in a manufacturing process of a transfer drum in accordance with the present invention.
Figure 19:
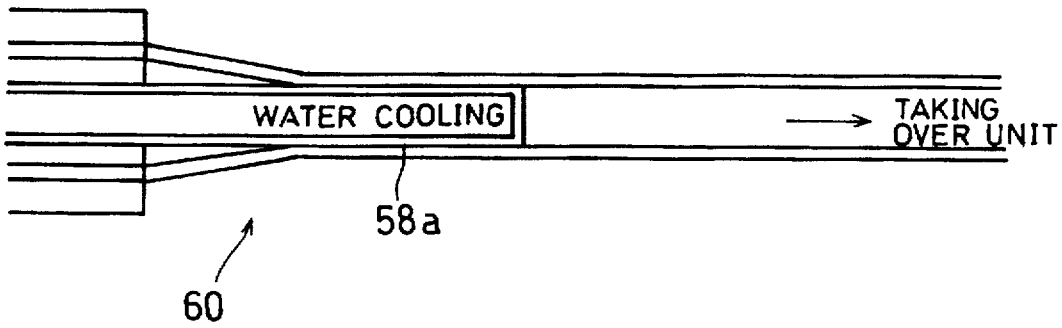
FIG. 19 is an explanatory view illustrating a forming method of the circular seamless thin film sheet for use with a transfer drum in accordance with the present invention.

The following description will explain a manufacturing method of the cylindrical seamless thin film sheet with reference to FIGS. 18 and 19, and particularly explain a case in which polyvinylidene fluoride is used as the cylindrical seamless thin film sheet. FIG. 18 shows a typical push-out machine 54 for heating and pushing out a raw material.

First, a raw material is supplied to a raw material hopper 55 of the push-out machine 54. The raw material hopper 55 supplies the raw material to a cylinder 56. The raw material supplied to the cylinder 56 is transported by a screw 57 in the cylinder 56 to a die section 59 having a circular aperture. Here, a heating and cooling unit 58 heats and plasticize the raw material in the cylinder 56. The plasticized raw material is then formed into a predetermined shape and thickness (sizing) by the die section 59.

As shown in FIG. 19, in the die section 59, the raw material is controlled in terms of shape and dimensions, while being cooled down and hardened by a cooling section **58*a* of a sizing section 60, and finally, cut in predetermined lengths by a pull-out device. Since the raw material is pulled out of the circular aperture of the die section 59**, the seamless thin film sheet of polyvinylidene fluoride can be formed.

It is relatively easy to give a heat shrinking property to the cylindrical seamless thin film sheet of polyvinylidene fluoride. The heat shrinking property is a property that a molecular anisotropy, formed by using a change in structure due to distortion of thermoplastic polar chain polymer, loses its fixed orientation and shows tendency to restore the original state when heated again.

A method for fixing the cylindrical seamless thin film sheet of polyvinylidene fluoride will be explained next. Heat-shrinking the cylindrical seamless thin film sheet of polyvinylidene fluoride as the dielectric layer 28 of the transfer drum 11 on the pressure conductive layer 27 allows the dielectric layer 28 to be extremely firmly fixed to the pressure conductive layer 27, and, greatly improves the toner transfer and the electrostatic attraction of the transfer sheet P onto the transfer drum 11 during multiprinting as well as during normal printing.

There are two heat shrinking methods for the dielectric layer 28: dry method and wet method. However, it should be taken into account that the permittivity and resistance of the dielectric layer 28 greatly affect the toner transfer and the attraction of the transfer sheet P. The dry heat shrinking method, which does not cause properties of the dielectric layer 28, such as the resistance and permittivity, to vary in a large amount, is preferable as the fixing method of the dielectric layer 28 of the transfer drum 11 of the present invention. Note that it is also possible to use a thermoplastic polar chain polymer other than polyvinylidene fluoride as the raw material for the cylindrical seamless thin film sheet.

The pressure conductive layer 27 and dielectric layer 28 composing the transfer drum 11 of the first through fifth embodiments above are preferably configured so that the pressure conductive layer 27 is narrower than the dielectric layer 28 with respect to the direction of the rotation axis of the transfer drum 11, and that the edges of the pressure conductive layer 27 are covered with the dielectric layer 28. By covering the edges of the pressure conductive layer 27 with the dielectric layer 28 in this manner, dew does not grow between the layers even at high humidity, allowing stable electrostatic attraction and toner transfer.

Figure 20:
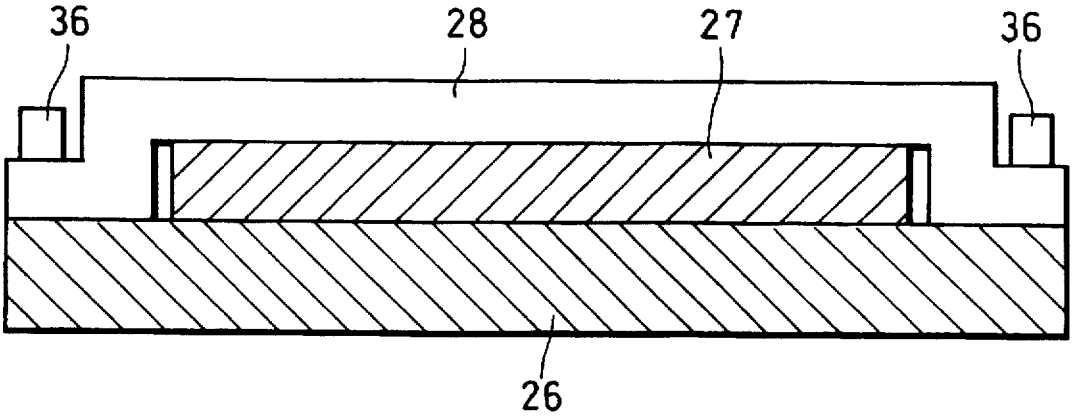
FIG. 20 is an explanatory view illustrating a method for tightly closing end portions of a pressure conductive layer of a transfer drum in accordance with the present invention.
Figure 21:
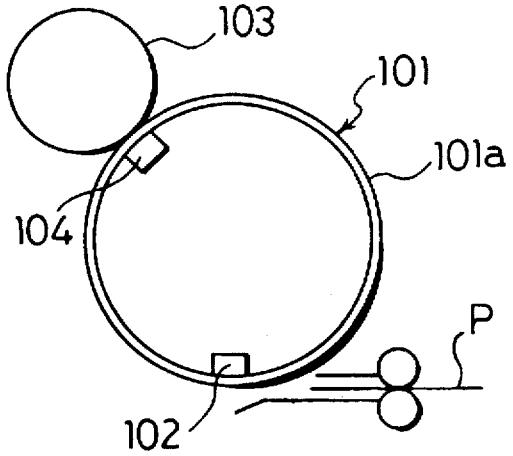
FIG. 21 is a schematic cross-sectional view showing an example of a transfer drum of a conventional image forming apparatus.
Figure 22:
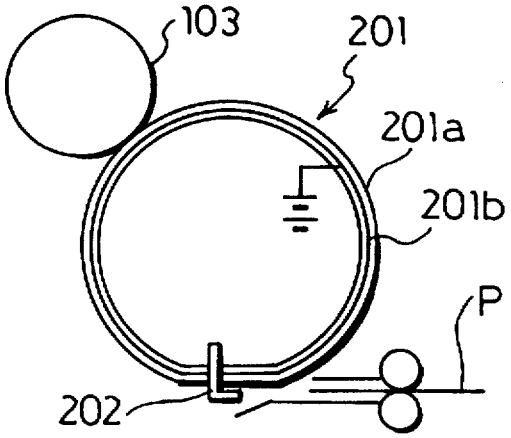
FIG. 22 is a schematic cross-sectional view showing another example of a transfer drum of a conventional image forming apparatus.

The transfer drum 11 of the above configuration can be obtained by firmly sealing the edges of the pressure conductive layer 27 with the dielectric layer 28. That is, as shown in FIG. 20, such a transfer drum 11 can be obtained by covering the edges of the pressure conductive layer 27, with respect to the axis direction of the transfer drum 11, with dielectric layer 28, and fixing the edges of the pressure conductive layer 27 with a fixing member 36 so that air does not flow in between the dielectric layer 28 and the conductive layer 26. This prevents dew from growing between the layers even at high humidity and enables the electrostatic attraction and toner transfer to be performed stably with respect to the environments.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

an image carrier on whose surface a toner image is formed, transfer means, including a dielectric layer, a pressure conductive layer whose volume resistivity falls by the application of pressure, and a conductive layer stacked in this order from a surface of the transfer means, for transferring the toner image formed on the image carrier onto a transfer material by electrically attracting and holding the transfer material onto a surface of the dielectric layer and by bringing the transfer material into contact with the image carrier, voltage applying means for applying a first voltage to the conductive layer, and a contact and charge member for coming into contact with the surface of the dielectric layer via the transfer material and for charging the transfer material.

2. The image forming apparatus as defined in claim 1, wherein the contact and charge member is a grounded first electrode member.

3. The image forming apparatus as defined in claim 1, wherein a contact pressure between the contact and charge member and the transfer means is set to be larger than a contact pressure between the image carrier and the transfer means.

4. The image forming apparatus as defined in claim 1, further comprising:

contact pressure adjusting means for adjusting the contact pressure between the contact and charge member and the transfer means.

5. The image forming apparatus as defined in claim 4, wherein a plurality of contact and charge members are provided, and the contact pressure adjusting means adjusts the contact and charge members.

6. The image forming apparatus as defined in claim 1, wherein the contact pressure adjusting means includes an eccentric cam for shifting relative positions of the contact and charge member and the transfer means.

7. The image forming apparatus as defined in claim 1, further comprising:

transfer material sensing means for sensing a kind of the transfer material, wherein the contact pressure adjusting means is configured to adjust the contact pressure between the contact and charge member and the transfer means according to the kind of the transfer material sensed by the transfer material sensing means.

8. The image forming apparatus as defined in claim 1, wherein the contact and charge member is a second electrode member connected to a power source supplying a second voltage having a polarity opposite to that of the first voltage.

9. The image forming apparatus as defined in claim 8, further comprising:

contact pressure and voltage adjusting means for adjusting the contact pressure between the second electrode member and the transfer means, and for adjusting the second voltage supplied to the second electrode member.

10. The image forming apparatus as defined in claim 9, wherein a plurality of second electrode members are provided, and the contact pressure and voltage adjusting means is configured so as to adjust the contact pressures between the second electrode members and the transfer means, and to adjust the second voltages supplied to the second electrode members.

11. The image forming apparatus as defined in claim 1, wherein the pressure conductive layer is formed by scattering metal particles in conductive rubber.

12. The image forming apparatus as defined in claim 11, wherein the conductive rubber is formed by scattering carbon black in rubber.

13. The image forming apparatus as defined in claim 11, wherein the conductive rubber is formed by scattering carbon black in foamed urethane rubber.

14. The image forming apparatus as defined in claim 11, wherein the metal particles are gold-plated iron powder.

15. The image forming apparatus as defined in claim 11, wherein the metal particles have an average diameter in a range of 5 μm to 20 μm.

16. The image forming apparatus as defined in claim 11, wherein the metal particles are contained in the pressure conductive layer at a ratio of 5 to 10 weight percent.

17. The image forming apparatus as defined in claim 1, wherein the dielectric layer of the transfer means is a cylindrical seamless thin film sheet and is fixed onto the pressure conductive layer with a heat shrinking method.

18. The image forming apparatus as defined in claim 1, wherein the pressure conductive layer is narrower than the dielectric layer with respect to a direction of an rotation axis of the transfer means, and an edge of the pressure conductive layer is covered with the dielectric layer.

19. The image forming apparatus as defined in claim 1, wherein the contact and charge member charges the transfer material so as to generate a potential difference between the transfer material and the conductive layer to which a voltage is applied.

20. The image forming apparatus as defined in claim 1, wherein the contact and charge member is disposed on an upstream side of a transfer position of the toner image onto the transfer material with respect to a direction along which the transfer material is transported.

21. The image forming apparatus as defined in claim 1, wherein the contact and charge member is a grounded roller.

22. The image forming apparatus as defined in claim 1, wherein the transfer means is a rotational drum for rotating at a predetermined rotational speed.

23. The image forming apparatus as defined in claim 1, further comprising:

pre-curl means for providing curvature in accordance with the surface of the transfer means to the transfer material supplied between the transfer material and the contact and charge member.

24. The image forming apparatus as defined in claim 1, further comprising:

discharging means for discharging electric charge of the dielectric layer.

25. The image forming apparatus as defined in claim 1, further comprising:

cleaning means for removing toner adhering onto the dielectric layer.

* * * * *